United States Patent [19]

Wray et al.

[11] 4,448,590

[45] May 15, 1984

[54] FLAP-TYPE ROTARY ABRASIVE DEVICE

[75] Inventors: Daniel J. Wray, Tujunga; Alexis G. Regnier, Los Angeles, both of Calif.

[73] Assignee: Standard Abrasives, Inc., Northridge, Calif.

[21] Appl. No.: 198,082

[22] Filed: Oct. 17, 1980

Related U.S. Application Data

[62] Division of Ser. No. 910,319, May 30, 1978, Pat. No. 4,258,509.

[51] Int. Cl.[3] ..... B24D 11/00

[52] U.S. Cl. ..... 51/297; 51/293

[58] Field of Search ..... 51/297, 293

[56] References Cited

U.S. PATENT DOCUMENTS

| | | | |
|---|---|---|---|
| 2,642,705 | 6/1953 | Jensen | 51/337 |
| 2,678,523 | 5/1954 | Leggett | 51/337 |
| 2,808,689 | 10/1957 | Thomson et al. | 51/297 |
| 2,842,902 | 7/1958 | Miller et al. | 51/337 |
| 2,991,165 | 7/1961 | Meyer et al. | 51/297 |
| 3,004,373 | 10/1961 | Brooks | 51/337 |
| 3,028,709 | 4/1962 | Hedden | 51/337 |
| 3,294,502 | 12/1966 | Schaffner | 51/297 |
| 3,406,488 | 10/1968 | Rykken | 51/337 |
| 3,468,642 | 9/1969 | Burns | 51/337 |
| 3,561,173 | 2/1971 | Block | 51/334 |
| 3,600,861 | 8/1971 | Haywood | 51/337 |
| 3,795,498 | 3/1974 | Hasegawa | 51/297 |

*Primary Examiner*—James H. Derrington

*Attorney, Agent, or Firm*—Nilsson, Robbins, Dalgarn, Berliner, Carson & Wurst

[57] ABSTRACT

A flap-type rotary abrasive device comprising a plurality of leaves of flexible material, arranged in an annular array having a central bore. End caps having annular passageways are provided to seal the central bore. A predetermined amount of a settable securing material having a liquid and a solid state, such as epoxy, is injected while in a liquid state into the central bore of the array so that a portion of the injected material contacts the inner edges of the leaves and a portion is caused to flow between the leaf edges adjacent the annular passageways formed by the end caps. Upon setting or solidification, the securing material, in conjunction with the two end caps, provides a core in which the leaf inner edges are solidly and firmly secured.

4 Claims, 9 Drawing Figures

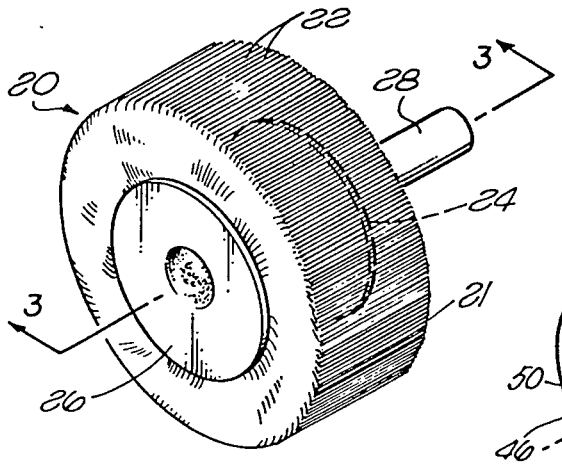
FIG. 1
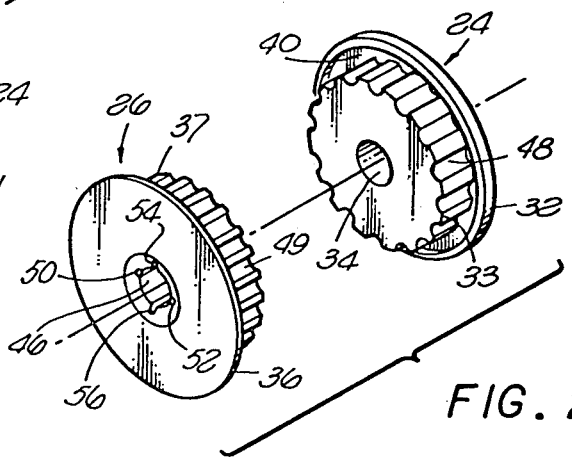
FIG. 2
FIG. 3
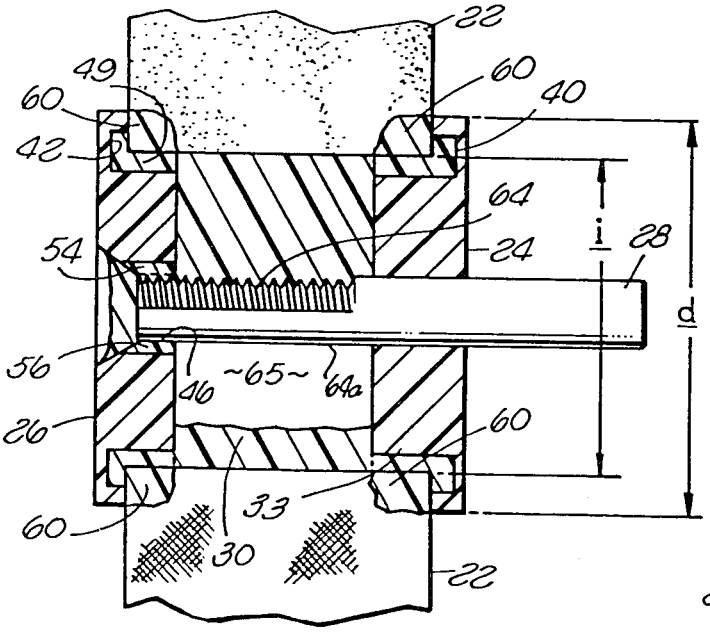
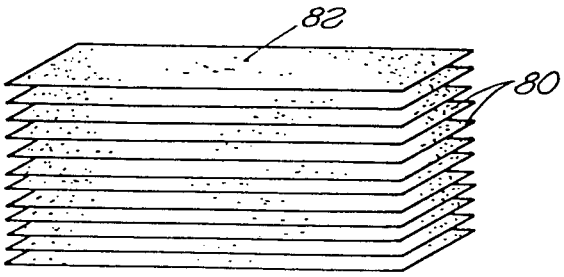
FIG. 4
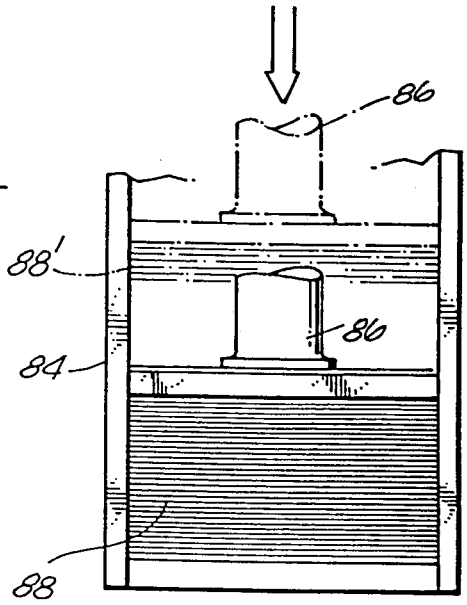
FIG. 5

FLAP-TYPE ROTARY ABRASIVE DEVICE

This is a division of application Ser. No. 910,319, filed May 30, 1978 now U.S. Pat. No. 4,258,509.

FIELD OF THE INVENTION

This invention relates to rotary abrasive devices and more particularly to flap-type abrasive devices having annular arrays of flexible abrasive leaves and a method of fabrication thereof.

BACKGROUND OF THE INVENTION

Flap-type rotary abrasive devices having annular arrays of flexible abrasive leaves are commonly used in the abrasive finishing art. Most conventional rotary abrasive devices consist of flexible leaves each comprising a piece of sheet material having abrasive particles bonded on one face thereof. Fabrication of such a rotary device conventionally requires that the abrasive leaves have two notches in their opposite side edges near the base end of each leaf. As the leaves are arranged in an annular array, the notches form concentric circular depressions on opposite sides of the array. Suitable circular reinforcement means such as two metallic end caps mounted on opposite sides of the array are provided, each end cap having an inwardly extending lip which engages the circular depressions thereby mechanically gripping the inner ends of the abrasive leaves. For further anchorage, a suitable adhesive is sometimes introduced into contact with the leaves at their base ends to bond them into a unitary core. Although a rotary abrasive device of the conventional configuration, performs suitably, its manufacture is rather expensive and requires two notches to be formed in each leaf prior to assembly, the forming of these notches being both time consuming and costly because they must be aligned properly with respect to each other and to receive accurate placement of the metal end caps.

SUMMARY OF THE INVENTION

The method of the present invention discloses an abrasive device having an annular array of abrasive leaves, each having smooth side edges and a base edge, and a method of fabrication thereof. A plurality of leaves of flexible material are provided, each leaf having abrasive particles bonded to at least one of its faces. The leaves are arranged in a stack so that a face of each leaf having the abrasive particle faces in one direction. The stack is subjected to high compression of approximately 2000 pounds per square inch, the compression being substantially perpendicular to the faces of the leaves. This compression causes successive leaves of the stack to adhere to one another by penetration of the abrasive particles of each leaf into an adjacent leaf, thereby transforming the stack of leaves into a rigid block. A groove is then formed in the block, the groove being substantially parallel to the edges of the individual leaves comprising the block. The block could be formed of sufficient width that several adjacent grooves could be formed. The grooves are then filled with a deformable adhesive. The block, if more than one groove is present in the block, can be cut so that individual arrays of abrasive leaves are formed, the base edges of each array being connected by the deformable adhesive present in the groove. The individual leaves of the array are then separated by any one of several methods, one of which could be blowing compressed air against the individual leaves. The array is formed into a circular configuration defining a central bore, the ends of the groove containing the deformable adhesive being connected by an additional amount of deformable adhesive. End caps are then provided, each end cap being configured so that during injection a settable securing material will be directed between side edge portions of the array adjacent to the base edges, the securing material being in a liquid state during injection.

In a particular embodiment, each end cap forms an annular passageway about the side edges of the array adjacent to the base edges, the passageway being connected by a plurality of channels to a central cavity formed by the end caps and the base edges of the array. Each of the end caps forms a centrally disposed aperture in which a holding spindle is slidably received, the spindle being aligned by the apertures and in sealing contact therewith. The spindle thus positioned in the end caps, a predetermined amount of a settable securing material having liquid and solid states is injected while in the liquid state into the central cavity and the end cap annular passageways. The securing material is injected so that it contacts the base edges of the leaves and flows between the side edges of the leaves abutting the annular passageways formed by the end caps. Upon solidification or setting of the securing material, a core formed of the securing material in the central cavity, the securing material forced between the leaves, and the end caps if bonded to the securing material is formed. It is this thus formed core which provides the required adhesion for the array to withstand the high centrifugal forces present during use of the device.

The abrasive device of the present invention comprises a circular array of abrasive leaves, having opposite side edges and inner and outer end edges, the inner end edges of which define a central bore, a holding spindle, which may be removable, disposed within the central bore, and a securing material which is disposed within the central bore and extends between the abrasive leaves side edges adjacent to the inner edges.

An important advantage of the invention is that side depressions do not need to be formed in the array, the forming thereof being both expensive and time-consuming and in addition thereto weakening the leaf ends so that they tear when rotated at high speeds. An array according to the present invention only requires a single groove formed perpendicular to the base edges of the array to retain the leaves together during fabrication. Tolerances on this groove are not particularly critical because the only purpose of the groove is to hold a deformable adhesive which in turn will hold the leaves together during injection of the securing material. Consequently, annular arrays according to the present invention can be produced rapidly, economically, and with a high assurance that they will withstand the forces present during operation and may be rotated at a surprisingly higher speed than heretofore thought possible.

BRIEF DESCRIPTION OF THE DRAWINGS

FIG. 1 is a perspective view of a rotary abrasive device according to the present invention;

FIG. 2 is a perspective view of the two end caps to be centrally disposed within the annular array of abrasive leaves;

FIG. 3 is a cross sectional view taken along lines 3—3 of FIG. 1 also illustrating alternative embodiments;

FIG. 4 is a perspective view of the abrasive sheets prior to compression;

FIG. 5 is a side elevational view showing the sheets as they are being subjected to a high compression force perpendicular to the faces of the sheets;

DETAILED DESCRIPTION

Figure 6:
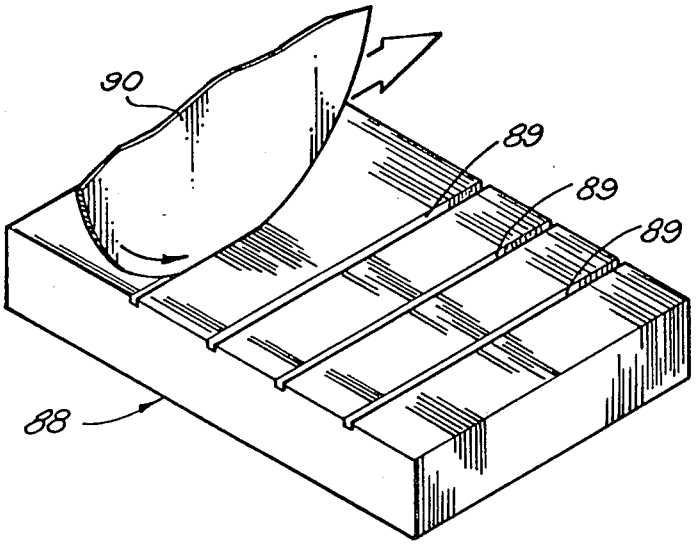
FIG. 6 is a perspective view of a block of sheets showing straight line grooves formed and being formed on the end edges thereof.

As required, a detailed illustrative embodiment of the invention is disclosed herein. This embodiment exemplifies the invention and is currently considered to be the best embodiment for such purposes. However, it is to be recognized that other end cap configurations for directing a settable holding material into the annular array and other groove configurations formed within the array base edges could be utilized. Accordingly, the specific embodiment disclosed is representative in providing a basis for the claims which define the scope of the present invention.

As previously explained, the invention discloses a flap-type rotary abrasive device comprising an annular array and a method of fabrication thereof. The leaves of the array have parallel opposed side and end edges, and the array is secured to end caps and a centrally disposed holding spindle by a settable securing material which is forceably injected between base edges and side edge portions of the leaves. The securing material must be of the type that can be injected while in a liquid state and settable subsequent to injection. The flow of securing material during injection is controlled by a unique end cap design which directs the flow of securing material between certain side edge portions during fabrication of the array.

Referring to FIG. 1, a flap-type rotary abrasive device 20 comprises an annular array of abrasive leaves 21 composed of individual leaves 22 having one abrasive surface and one smooth surface, the abrasive surface facing the smooth surface of an adjacent leaf. However, the annular array could contain abrasive leaves having two abrasive surfaces. The device 20 also comprises a first end cap 24 shown in phantom, a second end cap 26, and a holding or drive spindle 28 which can be gripped by the chuck of a hand-held drill, pneumatic motor or by any other commonly used power driving device. The abrasive leaves 22, end caps 24 and 26, and spindle 28 are interconnected by a settable securing material 30 shown in FIG. 3. In operation, the spindle 28 is rotated in the direction in which the abrasive sides of the individual leaves 22 face. It is important that the annular array 21 rotate at a high angular velocity in order that rapid abrasion can be effected. This high angular velocity creates a significant centrifugal force outwardly, thereby requiring that the leaves 22 be securely fastened so that the array will not come apart during operation. According to the present invention the leaves 22 are secured solely by the solidified securing material 30 which is injected between the leaves 22, the flow of material 30 during an injection process being partially directed by end caps 24 and 26 having uniquely contoured inner surfaces.

Referring to FIGS. 2 and 3, the first end cap 24 comprises an outer flange 32 and an inner plug 33, and forms a centrally disposed aperture 34 in which the spindle 28 is held in sealing contact. In a similar manner, the second end cap 26 comprises an outer flange 36 and an inner plug 37. The outer periphery of each of the flanges 32 and 36 is continuous as shown in FIG. 2. The diameter "d" of the end caps 24 and 26 is slightly larger than the inner diameter "i" of the annular array of abrasive leaves 21, the overlapping portions of the flanges 32 and 36 forming annular passageways 40 and 42 in their inner surfaces. These annular passageways 40 and 42, are open to lower side edge portions of the individual leaves 22 so that the securing material 30 can be directed therebetween as will be explained below. The first and second end caps 24 and 26 inner plugs 33 and 37 have diameters substantially equal to the inner diameter "i" of the annular array 21. It is this coincidence of diameters that provides for positioning and alignment of the centrally disposed aperture 34 in the first end cap 24 and a centrally disposed aperture 46 in the second end cap 26, thereby providing a means for alignment of the holding spindle 28 as will be explained below. The perimeters of the inner plugs 33 and 37 have a plurality of semicircular channels 48 and 49 which open into the annular passageways 40 and 42 respectively.

Referring to FIG. 3 specifically which is taken through a channel 49 with respect to end cap 26 and through the outer diameter of the plug 33 of the end cap 24, as is illustrated the channel 49 of the second end cap 26 provides access to the annular passageway 42, whereas the end cap 24 itself is positioned by the outer diameter inner plug 33. Those skilled in the art will readily recognize that the channels 48 and the plug 37 on the end caps 24 and 26 respectively function as just described. The spindle 28 is held in sealing contact by the centrally disposed apertures 34 and 46 of the first and second end caps 24 and 26 respectively. The end caps are press fitted onto the spindle to secure them in place and to align them along with the leaves. The second end cap 26 has four injection apertures 50, 52, 54 and 56 through which the securing material 30 can be injected while in a liquid state. The settable securing material 30 is injected through the injection apertures 50 through 56 with sufficient pressure to force some of the securing material 30 into contact with the base edges of the annular array 21, through the annular passageways 40 and 42, and between the lower side edge portions of the leaves 22, the injected material being represented by the cross hatched lines as shown at 60.

It should be noted that the settable material 30 is caused to flow between the leaves 22 adjacent the side edges thereof. It is this sideward injection as directed by the annular passageways 40 and 42 which provides unexpected strength and support to the leaves 22, thereby allowing the annular array 21 to withstand much higher rotational rates than would be possible if the material were only injected into the central cavity. Some of the securing material may penetrate slightly between the end edges of the leaves but does not add materially to the structural strength of the device. The spindle 28 portion centrally disposed within the array may contain threads 64 which serve to hold the spindle 28 in position subsequent to setting of the material 30.

Alternatively, the spindle may be smooth surfaced as shown at 64 and it has been found that the settable material will bond thereto when set. However, in a further embodiment of the invention, the spindle 28 could be replaced by a smooth TEFLON rod which could be slidably removed after the material has set, thereby providing an array having a central bore of predetermined diameter and orientation. TEFLON is a trademark of E. I. duPont de Nemours & Company, Inc. for fluorocarbon resins. As a further embodiment, useful particularly for larger devices, a removable plug or diverter may be inserted internally to direct the settable material to the outer edge of the cavity into contact with the leaves as above described. Such will cause a cavity as shown at 65 to remain.

It is important that a predetermined amount of settable material 30 be utilized. Too little material will result in insufficient holding of the leaves 22, and too much material will result in an outward flow to such an extent that flexibility of the leaves 22 will be inhibited. A proper amount of material 30 will result in an outward flow adjacent to the edges of the outer flanges 32 and 36. In a specific embodiment, the first end cap 24 and second end cap 26 are formed of fiberblass reinforced polyester and the settable material is epoxy, the end caps 24 and 26 being bonded to the epoxy as it sets or solidifies. Any other material could also be utilized for the end caps 24 and 26, to which epoxy will bond. It is believed that for larger annular arrays, a metal stamping could be utilized for the end caps 24 and 26. It would also be possible to utilize end caps only for the purpose of directing the securing material to the lower side edges of the leaves, the end caps being removable subsequent to solidification of the securing material.

Figure 7:
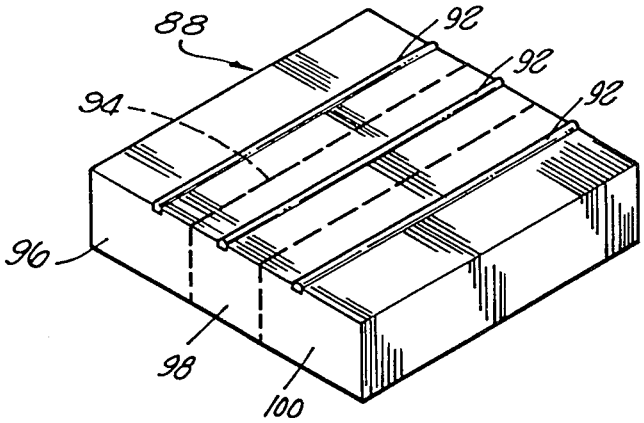
FIG. 7 is a perspective view showing the flexible adhesive disposed within the grooves of FIG. 6 and dotted lines showing how the blocks can be cut to form individual arrays.
Figure 8:
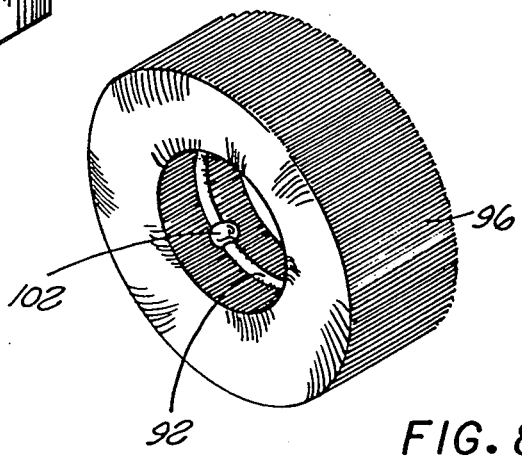
FIG. 8 is a perspective view of one of the FIG. 7 linear arrays having been formed into an annular array.
Figure 9:
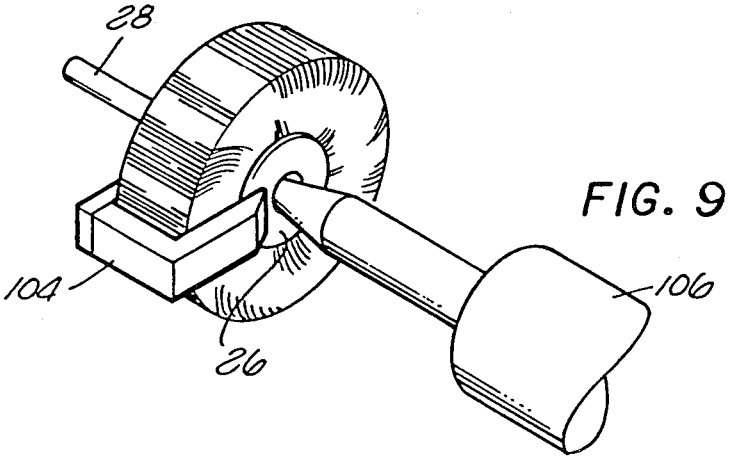
FIG. 9 is a perspective view of an array containing the centrally disposed spindle as liquified epoxy is being forceably injected into the central cavity of the array.

A method of producing the above described device 20 is disclosed by reference to FIGS. 4 through 9. Referring to FIG. 4, a plurality of abrasive sheets 80 having abrasive particles 82 on one face thereof are stacked so that the faces having the abrasive particles all face in the same direction. Sheets having abrasive particles on both sides could be utilized in another embodiment. In a specific application, the abrasive sheets 80 could be one inch by six inches, although other dimensions could be utilized equally well depending upon the desired configuration of the annular array of abrasive leaves. The stacked sheets 80 are registered with respect to each other and placed in a holding fixture 84 as shown in FIG. 5. A hydrualic ram 86 is used to compress the sheets 80, as represented in their uncompressed state by the dotted lines as shown at 88', into a block as shown at 88, the block 88 having the particles of each sheet embedded in an adjacent face of the next sheet. It has been found that a pressure of approximately 2000 p.s.i. is sufficient to transform the single sheets 80 into an apparently solid block 88. Referring to FIG. 6, grooves 89 are cut in the solid block 88 by a saw 90, the grooves being perpendicular to the longitudinal edges of the abrasive sheets 80. Although a saw is illustrated, the grooves 89 could be formed in other ways, a laser cutting apparatus being one example thereof. A hot melt glue 92 is disposed within the grooves 89 as shown in FIG. 7, the hot melt glue 92 being flexible when in a cured state. The block 88 is then cut into individual arrays as shown by the dotted lines 94, the specific block shown providing three arrays 96, 98 and 100. One can appreciate that by a suitable spacing of the grooves 89, arrays comprising leaves of various or of identical widths can be formed from a single block. Utilizing the first array 96 as an example, the leaves 22 are separated from each other, one method known in the art being to subject them to an air jet. The array 96 is then formed into a circular configuration as shown in FIG. 8, the hot melt glue 92 at each end of the array being fused by additional glue 102. The first end cap 24, not shown, the second end cap 26, and spindle 28 are positioned within the array 96 as previously explained and held by any of a number of suitable holding fixtures 104 as shown in FIG. 9 to supply sufficient pressure to retain the settable securing material 30 during injection within the cavity formed between the end caps and the base edges. Alternatively by press fitting the end caps onto the spindle as above described provides sufficient holding power to retain the securing material in place during the injection step. Means 106 for injecting a predetermined amount of securing material is inserted against the injection apertures 50 through 56, and a predetermined amount of mateial under a predetermined pressure is forced therethrough, the material penetrating outwardly adjacent the leaves 22 and sideways into the leaves 22 from the annular passageways 40 and 42 as previously explained. Upon completion of the injection, the material sets thereby providing the flap-type rotary abrasive device according to the present invention.

We claim:

1. A method of fabricating a flap-type rotary abrasive device comprising an annular array of abrasive leaves having opposite side edges and base edges, said annular array having an inner surface formed by said base edges facing radially inward, each leaf having abrasive particles bonded to at least one face thereof, comprising the steps of:

providing a plurality of leaves of flexible material, each leaf having abrasive particles bonded to at least one face thereof; arranging the plurality of leaves in a stack so that a face of each leaf having abrasive particles faces in one direction;

subjecting the stack to high compression substantially perpendicular to the leaf faces to cause successive leaves of the stack to adhere to one another by penetration of abrasive particles of each leaf into an adjacent leaf, thereby transforming the stack of leaves into a rigid block;

forming at least one straight line groove in the rigid block, the groove being substantially perpendicular to a base edge of each leaf;

filling said groove with a deformable adhesive;

loosening the leaves from face to face adherence to each other, each leaf defining a leaf of said array, the array of leaves being interconnected by said deformable adhesive at said base edges;

forming said loose array into a circular configuration defining a central bore the boundary of which is determined by said base edges;

providing two centrally disposed end caps one at each end of said bore, each end cap forming an annular passageway around the side edges adjacent to said base edges of the leaves, said passageway having at least one access aperture into said central bore;

disposing a spindle centrally of said bore; and inserting a settable securing material having a liquid and a solid state into said central bore while in a liquid state to substantially fill said bore and flow through said access aperture and said annular passageways into contact with the side edges adjacent the base edges of said leaves so that said material penetrates slightly between said leaves at the side edges thereof adjacent said base edges, said securing material becoming solidified subsequent to insertion.

2. The method of claim 1 further including the step of providing said centrally disposed end caps adapted to hold said centrally mounted spindle, the spindle extending through and making sealing contact with one end cap, the other end cap providing means to align said spindle longitudinal axis perpendicular to said array side edges, said end caps providing at least one aperture through which said securing material can be injected.

3. The method of claim 1 further including the step of providing said end caps formed of polystyrene and said securing material of epoxy.

4. The method of claim 3 further including the step of providing a smooth fluorocarbon resin rod as said spindle thereby allowing said teflon rod to be removed after the epoxy sets.

* * * * *

UNITED STATES PATENT AND TRADEMARK OFFICE

CERTIFICATE OF CORRECTION

PATENT NO. : 4,448,590

DATED : May 15, 1984

INVENTOR(S) : Daniel J. Wray et al.

It is certified that error appears in the above-identified patent and that said Letters Patent is hereby corrected as shown below:

Column 5, line 48, "hydrualic" should read -- hydraulic --.

Signed and Sealed this

*Fifth* Day of *February 1985*

[SEAL]

*Attest:*

DONALD J. QUIGG

*Attesting Officer*

*Acting Commissioner of Patents and Trademarks*